US006616813B2

(12) United States Patent
Komposch

(10) Patent No.: US 6,616,813 B2
(45) Date of Patent: Sep. 9, 2003

(54) PRESSING ARRANGEMENT

(75) Inventor: Gerd Komposch, Nattheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/922,797

(22) Filed: Aug. 7, 2001

(65) Prior Publication Data

US 2002/0060048 A1 May 23, 2002

(30) Foreign Application Priority Data

Aug. 31, 2000 (DE) ..... 100 42 906

(51) Int. Cl.[7] ..... D21F 3/00

(52) U.S. Cl. ..... 162/358.3; 162/205; 100/37

(58) Field of Search ..... 162/204, 205, 162/206, 210, 305, 199, 358.1, 358.2, 358.3, 358.4, 358.5, 359.1, 360.2; 100/153, 155 R, 156, 160, 162 R, 37–42; 492/7

(56) References Cited

U.S. PATENT DOCUMENTS

| | | | | |
|---|---|---|---|---|
| 4,931,142 A | * | 6/1990 | Steiner et al. | 100/153 |
| 4,988,410 A | | 1/1991 | Meinecke et al. | 162/360.2 |
| 5,167,768 A | * | 12/1992 | Cronin et al. | 162/205 |
| 5,997,695 A | * | 12/1999 | Ilmarinen | 162/358.3 |
| 6,158,334 A | * | 12/2000 | Safman et al. | 100/153 |
| 6,158,335 A | | 12/2000 | Säfman et al. | 100/47 |
| 6,164,198 A | | 12/2000 | Honkalampi et al. | 100/327 |
| 6,213,009 B1 | | 4/2001 | Sätman | 100/38 |
| 6,248,210 B1 | * | 6/2001 | Edwards et al. | 162/109 |
| 2001/0017084 A1 | | 8/2001 | Honkalampi et al. | 100/38 |

FOREIGN PATENT DOCUMENTS

| | | |
|---|---|---|
| DE | 8805966 | 10/1989 |
| DE | 29902451 | 7/1999 |
| GB | 2218122 | 8/1989 |

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Pressing arrangement for treating a fibrous material web that includes opposing surface and shoe press roll including non-rotationally mounted carrier, flexible pressing jacket arranged to circulate around carrier, and at least one press shoe supported on carrier. The at least one press shoe is arranged to press flexible pressing jacket against opposing surface. Shoe press roll and opposing surface are arranged to form press nip elongated in jacket travel direction, and the at least one press shoe includes outlet arranged to extend beyond, in jacket travel direction, an end of press nip. The at least one press shoe is arranged to press pressing jacket against opposing surface such that, in a region of press nip, pressing jacket is moved radially outside of a circular path formed by pressing jacket in an unstressed state, and pressing jacket is arranged to rest against a free end of outlet.

30 Claims, 1 Drawing Sheet

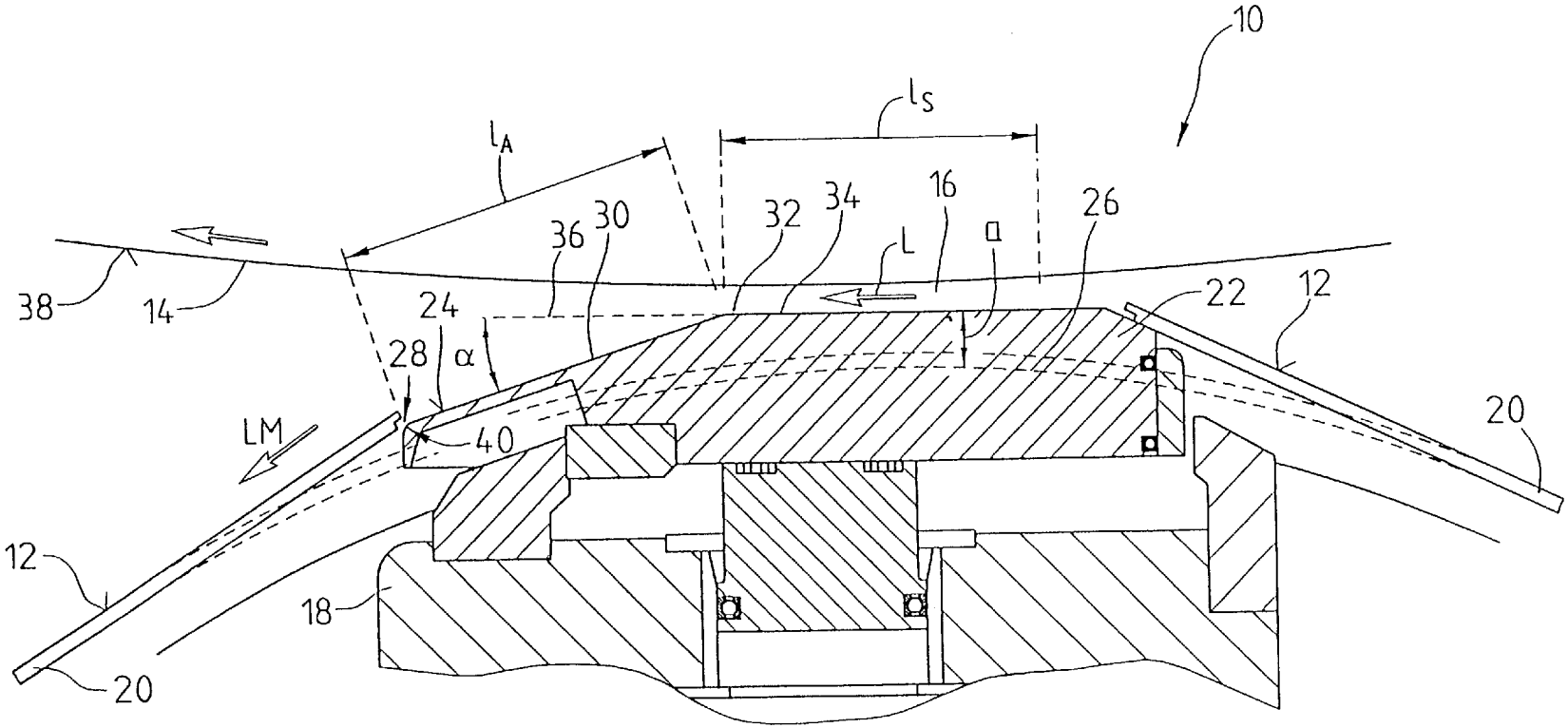
10
20
12
22
26
16
34
32
30
36
40
24
28
14
38
18
LM
L
$L_S$
$L_A$
α

PRESSING ARRANGEMENT

CROSS-REFERENCE TO RELATED APPLICATIONS

The present application claims priority under 35 U.S.C. §119 of German Patent Application No. 100 42 906.8, filed on Aug. 31, 2001, the disclosure of which is expressly incorporated by reference herein in its entirety.

BACKGROUND OF THE INVENTION

1. Field of the Invention

The invention relates to a pressing arrangement for treating a fibrous material web, in particular a paper, cardboard, or tissue web, in a press nip formed between a shoe press roll and an opposing surface and elongated in the web travel direction.

2. Discussion of Background Information

As a rule, the fibrous material web is guided through the press nip with at least one dewatering belt, for example, a felt.

In the pressing arrangements of the type mentioned at the outset that have been common up to now, the pressing jacket exits the press nip in a large radius that is determined by its own stiffness, centrifugal forces, and the line load of the pressing jacket. Correspondingly, the separation of the paper and the felt does not occur until far outside of the press nip, which has the result that the reverse moistening of the paper occurring up to the separation from the felt is very high, in particular in the case of thinner papers such as tissue papers.

SUMMARY OF THE INVENTION

The present invention provides a pressing arrangement of the type mentioned at the outset in which such a reverse moistening is reduced to a minimum and with which a considerably greater dry content of the fibrous material web may be correspondingly achieved.

According to the instant invention, a pressing arrangement is provided for treating a fibrous material web, in particular a paper, cardboard, or tissue web, with a press nip formed between a shoe press roll and an opposing surface is elongated in the web travel direction. The shoe press roll includes a carrier that is mounted in a non-rotational manner, a pressing jacket circulating around the carrier, and at least one press shoe supported on the carrier, such that the flexible pressing jacket may be pressed against the opposing surface. Further, the press shoe is extended in the jacket travel direction past the pressing nip by an outlet, and the pressing jacket is guided through the outlet when the press shoe is pressed against the opposing surface in such a way that, in a region of the press nip, the pressing jacket runs radially outside of the circular path that would result from an assumed constantly cylindrical web guidance and rests against it in the region of the free end of the outlet.

Based on this construction, a reduction of the reverse moistening is attained by a corresponding guidance of the pressing jacket outside of the press nip, which correspondingly leads to a considerably higher dry content of the fibrous material web. After the press shoe is provided with a longer outlet and presses relatively far outside of the undeformed pressing jacket contour in the operational setting, the pressing jacket lies against the region of the end of the outlet during operation and thus seals off the outlet region in an airtight manner. Because this eliminates a ventilation at the rear of the region, the pressing jacket must follow the outlet contour precisely, which brings about an immediate separation of the felt and fibrous material web outside of the pressing nip.

In a preferred embodiment of the pressing arrangement according to the invention, the length of the outlet, viewed in the jacket travel direction, is greater than approximately half the length of the press nip, in particular greater than approximately three quarters of the length of the press nip, and preferably greater than or equal to about the length of the press nip.

When the pressing shoe is pressed against the opposing surface, it is advantageous for the pressing jacket to be guided through it in such a way that it drifts out of the imaginary circular path in the region of the press nip by an amount corresponding on the average to approximately 1 to approximately 3%, in particular approximately 1.5 to approximately 2.5%, and in particular approximately 2% of the diameter of the circular path.

The outlet can have an at least essentially even surface facing the pressing jacket.

It is advantageous for the surface of the outlet facing the pressing jacket, which is at least essentially even, to form an angle in the range of approximately 18° with the tangent resting against the pressing surface of the press shoe defining the press nip and facing the pressing jacket on the press nip outlet.

It is useful for the contour of the pressing surface of the press shoe facing the pressing jacket and defining the press nip to be adapted to the contour of the opposing surface.

The opposing surface can be formed, for example, by an opposing roll. Especially in this case, the pressing surface of the press shoe facing the pressing jacket and defining the press nip can therefore have a generally concave contour.

In a useful practical embodiment, the outlet is bent generally radially inwards on its free end. Here, the pressing jacket can rest against the outlet in the preferably rounded transitional region to the end of the outlet, which is generally bent radially inwards.

The invention shall be described in greater detail in the following using an exemplary embodiment with reference to the drawing.

The present invention is directed to a pressing arrangement for treating a fibrous material web. The pressing arrangement includes an opposing surface and a shoe press roll including a non-rotationally mounted carrier, a flexible pressing jacket arranged to circulate around the carrier, and at least one press shoe supported on the carrier. The at least one press shoe is arranged to press the flexible pressing jacket against the opposing surface. The shoe press roll and the opposing surface are arranged to form a press nip elongated in a jacket travel direction, and the at least one press shoe includes an outlet arranged to extend beyond, in the jacket travel direction, an end of the press nip. The at least one press shoe is arranged to press the pressing jacket against the opposing surface such that, in a region of the press nip, the pressing jacket is moved radially outside of a circular path formed by the pressing jacket in an unstressed state, and the pressing jacket is arranged to rest against a free end of the outlet.

In accordance with a feature of the invention, the fibrous material web may include one of a paper, cardboard, or tissue web.

Further, in the jacket travel direction, a length of the outlet may be greater than approximately one-half a length of the press nip. Preferably, the length of the outlet can be greater than approximately three quarters of the length of the press nip, and most preferably, the length of the outlet may be greater than or equal to about the length of the press nip.

Moreover, when the press shoe is pressed against the opposing surface, the pressing jacket, in the region of the press nip, can be moved a distance from the circular path of between approximately 1 to approximately 3% of a diameter of the circular path. Preferably, the distance from circular path moved by the pressing jacket, in the region of the press nip, can be between approximately 1.5 and approximately 2.5% of the diameter of the circular path, and most preferably, the distance from the circular path moved by the pressing jacket, in the region of the press nip, may be approximately 2% of the diameter of the circular path.

According to another feature of the present invention, the outlet may include at least essentially even surface arranged to face the pressing jacket. The at least essentially even surface of the outlet can be arranged to form an angle of approximately 18° to a tangent resting against a pressing surface of the at least one press shoe that is arranged to define the press nip. A contour of the pressing surface facing the pressing jacket and defining the press nip can be structured to correspond to a contour of the opposing surface. The opposing surface may be formed by an opposing roll. Further, the pressing surface facing the pressing jacket and defining the pressing nip may be structured with a generally concave contour.

In accordance with still another feature of the invention, the free end of the outlet can be structured to be bent generally radially inwardly.

Moreover, the free end of the outlet can include a rounded transitional region generally bent radially inwardly, and the pressing jacket can be arranged to rest against the outlet.

The pressing arrangement of the instant invention can also include at least one dewatering belt. The fibrous material web may be guided through the press nip along with the at least one dewatering belt. The at least one dewatering belt can include a felt.

The present invention is directed to an apparatus for treating a fibrous material web. The apparatus includes a shoe press roll having a flexible rotatable roll jacket and at least one press shoe arranged to press against an inner surface of the roll jacket and an opposing surface. The shoe press roll and the opposing surface are arranged to form a press nip elongated in a roll jacket travel direction. The press shoe includes a press surface structured and arranged to define the press nip and an outlet surface positioned obliquely adjacent an end of the press surface forming an exit of the press nip, in relation to the roll jacket travel direction. The at least one press shoe is arranged to press the roll jacket against the opposing surface such that, in a press nip region, the pressing jacket is moved radially outside of a circular path formed by the pressing jacket in an unstressed state.

In accordance with a feature of the instant invention, in the roll jacket travel direction, a length of the outlet surface can be greater than approximately one-half a length of the press nip. Further, the length of the outlet surface can be greater than approximately three quarters of the length of the press nip, and the length of the outlet surface may be greater than or equal to about the length of the press nip.

Further, when the press shoe is pressed against the opposing surface, the roll jacket, in the region of the press nip, may be moved a distance from the circular path of between approximately 1 to approximately 3% of a diameter of the circular path. Still further, the distance from circular path moved by the roll jacket, in the region of the press nip, may be between approximately 1.5 and approximately 2.5% of the diameter of the circular path, and the distance from the circular path moved by the pressing jacket, in the region of the press nip, can be approximately 2% of the diameter of the circular path.

According to another feature of the present invention, the outlet surface can be obliquely arranged adjacent the press surface to form an angle of approximately 18° to the press surface.

A free end of the outlet surface opposite the press surface may include a rounded transitional region. Further, the rounded transitional region can be structured to be bent radially inwardly.

In accordance with yet another feature of the instant invention, at least one dewatering belt can be structured and arranged to guide the fibrous material web through the press nip.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of a non-limiting example of an exemplary embodiment of the present invention, and wherein:

The FIGURE schematically illustrates an exemplary embodiment of a pressing arrangement in accordance with the instant invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The sole FIGURE of the drawing shows a schematic partial depiction of a pressing arrangement 10 for treating a fibrous material web in a press nip 16 elongated in the web travel direction L and formed between a shoe press roll 12 and an opposing surface 14. The fibrous material web (not shown here) can be a paper, cardboard, or tissue web. As a rule, it is guided through the elongated press nip 16 along with at least one dewatering belt (not shown), in particular a felt.

The shoe press roll 12 includes a non-rotationally mounted carrier 18, a flexible pressing jacket 20 circulating around the carrier 18, and at least one press shoe 22 supported on the carrier 18 by way of which the flexible pressing jacket 20 may be pressed against the opposing surface 14.

As can be seen in the sole figure, the press shoe 22 is elongated past the pressing nip 16 by an outlet 24. In operation, i.e., when the press shoe 22 is pressed against the opposing surface 14, the pressing jacket 20 is guided through the press shoe in such a way that it drifts in the region of the pressing nip 16 radially outside of the circular path 26 that would result from an assumed constantly circular web guidance and rests against the outlet in the region of the free end 28 of the outlet 24.

In the jacket travel direction LM, the length $l_A$ of the outlet 24 can, in particular be greater than approximately half the length $l_S$ of the press nip 16, in particular greater than approximately three quarters of the length $l_S$ of the press nip 16, and preferably greater than or equal to the length $l_S$ of the press nip 16. In the exemplary embodiment shown, the outlet 24 has a length at least essentially equal to that of the press nip 16.

Additionally, in operation, i.e., when the press shoe 22 is pressed against the opposing surface 14, the pressing jacket 20 is guided through the press shoe in such a way that it drifts out of the imaginary circular path 26 by an amount a in the region of the press nip 16. On the average, this amount a can correspond to approximately 1 to approximately 3%, in particular approximately 1.5 to approximately 2.5%, and in particular approximately 2% of the diameter of the imaginary circular path 26.

The outlet 24 can have an at least essentially even (planar)surface 30 that is facing the pressing jacket 20.

In the present case, this preferably at least essentially even surface 30 of the outlet 24 forms an angle $\alpha$ in the range of, for example, approximately 18°, with the tangent 36 located against the pressing surface 34 of the press shoe 22 defining the pressing nip 16 and facing the pressing jacket 20 on the press nip outlet 32.

The contour of the pressing surface 34 of the press shoe 22 facing the pressing jacket 20 and defining the press nip 16 can be adapted to the contour of the opposing surface 14.

In the present case, the opposing surface 14 is formed by an opposing roll 38. Correspondingly, the pressing surface 34 facing the pressing jacket 20 and defining the press nip 16 can have a generally concave contour.

In the present case, the outlet 24 is bent generally radially inwards on its free end 28. Here, the pressing jacket 20 rests against the outlet 24 in the preferably rounded transitional region 40 to the end of the outlet, which is generally bent radially inwards.

By the deliberate guidance of the pressing jacket outside the press nip, the reverse moistening is reduced to a minimum, whereby a considerably higher dry content of the fibrous material web results. The press shoe is provided with a long outlet and, in the operational setting, is pressed further out of the undeformed jacket contour than is the case in the embodiments up to now. Thus, during operation, the pressing jacket lies against the end of the outlet and, in this manner, seals off the outlet region in an airtight manner. Because ventilation at the rear of this region is thus eliminated, the pressing jacket must follow the outlet contour exactly, whereby an immediate separation of the felt and fibrous material web outside of the press nip is brought about.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 Pressing arrangement
12 Shoe press roll
14 Opposing surface
16 Elongated press nip
18 Rotationally secured carrier
20 Flexible pressing jacket
22 Press shoe
24 Outlet
26 Circular path
28 Free end
30 Surface
32 Press nip outlet
34 Pressing surface
36 Tangent
38 Opposing roll
40 Rounded transitional region
a Amount
$l_A$ Length of the outlet
$l_S$ Length of the press nip
L Web travel direction
LM Jacket travel direction
$\alpha$ Angle

What is claimed:

1. A pressing arrangement for treating a fibrous material web, comprising:

an opposing surface;

a shoe press roll including a non-rotationally mounted carrier, a flexible pressing jacket arranged to circulate around said carrier, and at least one press shoe supported on said carrier, wherein said at least one press shoe is arranged to press said flexible pressing jacket against said opposing surface;

said shoe press roll and said opposing surface being arranged to form a press nip elongated in a jacket travel direction;

said at least one press shoe comprising an outlet arranged to extend beyond, in the jacket travel direction, an end of said press nip;

said at least one press shoe being arranged to press said pressing jacket against said opposing surface such that, in a region of said press nip, said pressing jacket is moved radially outside of a circular path formed by said pressing jacket in an unstressed state; and said pressing jacket being arranged to rest against a free end of said outlet, wherein, in the jacket travel direction, a length of said outlet surface is greater than approximately one-half a length of said press nip.

2. The pressing arrangement in accordance with claim 1, wherein the fibrous material web comprises one of a paper, cardboard, or tissue web.

3. The pressing arrangement in accordance with claim 1, wherein said length of said outlet surface is greater than approximately three quarters of said length of said press nip.

4. The pressing arrangement in accordance with claim 1, wherein said length of said outlet is greater than or equal to about said length of said press nip.

5. The pressing arrangement in accordance with claim 1, wherein said outlet surface comprises an at least essentially even surface arranged to face said pressing jacket.

6. The pressing arrangement in accordance with claim 1, further comprising at least one dewatering belt, wherein the fibrous material web is guided through said press nip along with said at least one dewatering belt.

7. The pressing arrangement in accordance with claim 6, wherein said at least one dewatering belt comprises a felt.

8. A pressing arrangement for treating a fibrous material web, comprising:

an opposing surface;

a shoe press roll including a non-rotationally mounted carrier, a flexible pressing jacket arranged to circulate around said carrier, and at least one press shoe supported on said carrier, wherein said at least one press shoe is arranged to press said flexible pressing jacket against said opposing surface;

said shoe press roll and said opposing surface being arranged to form a press nip elongated in a jacket travel direction;

said at least one press shoe comprising an outlet arranged to extend beyond, in the jacket travel direction, an end of said press nip;

said at least one press shoe being arranged to press said pressing jacket against said opposing surface such that, in a region of said press nip, said pressing jacket is moved radially outside of a circular path formed by said pressing jacket in an unstressed state; and said pressing jacket being arranged to rest against a free end of said outlet, wherein, when said press shoe is pressed against said opposing surface, said pressing jacket, in said region of said press nip, is moved a distance from the circular path of between approximately 1 to approximately 3% of a diameter of the circular path.

9. The pressing arrangement in accordance with claim 8, wherein the distance from circular path moved by said pressing jacket, in said region of said press nip, is between approximately 1.5 and approximately 2.5% of the diameter of the circular path.

10. The pressing arrangement in accordance with claim 8, wherein the distance from the circular path moved by said pressing jacket, in said region of said press nip, is approximately 2% of the diameter of the circular path.

11. A pressing arrangement for treating a fibrous material web, comprising:

an opposing surface;

a shoe press roll including a non-rotationally mounted carrier, a flexible pressing jacket arranged to circulate around said carrier, and at least one press shoe supported on said carrier, wherein said at least one press shoe is arranged to press said flexible pressing jacket against said opposing surface;

said shoe press roll and said opposing surface being arranged to form a press nip elongated in a jacket travel direction;

said at least one press shoe comprising an outlet surface arranged to extend beyond, in the jacket travel direction, an end of said press nip;

said at least one press shoe being arranged to press said pressing jacket against said opposing surface such that, in a region of said press nip, said pressing jacket is moved radially outside of a circular path formed by said pressing jacket in an unstressed state; and said pressing jacket being arranged to rest against a free end of said outlet surface, wherein said outlet surface comprises an at least essentially even surface arranged to face said pressing jacket and said at least essentially even surface of said outlet surface is arranged to form an angle of approximately 18° to a tangent resting against a pressing surface of said at least one press shoe that is arranged to define said press nip.

12. The pressing arrangement in accordance with claim 10, wherein a contour of said pressing surface facing said pressing jacket and defining said press nip is structured to correspond to a contour of said opposing surface.

13. The pressing arrangement in accordance with claim 11, wherein said opposing surface is formed by an opposing roll.

14. The pressing arrangement in accordance with claim 11, wherein said pressing surface facing said pressing jacket and defining said pressing nip is structured with a generally concave contour.

15. A pressing arrangement for treating a fibrous material web, comprising:

an opposing surface;

a shoe press roll including a non-rotationally mounted carrier, a flexible pressing jacket arranged to circulate around said carrier, and at least one press shoe supported on said carrier, wherein said at least one press shoe is arranged to press said flexible pressing jacket against said opposing surface;

said shoe press roll and said opposing surface being arranged to form a press nip elongated in a jacket travel direction;

said at least one press shoe comprising an outlet surface arranged to extend beyond, in the jacket travel direction, an end of said press nip;

said at least one press shoe being arranged to press said pressing jacket against said opposing surface such that, in a region of said press nip, said pressing jacket is moved radially outside of a circular path formed by said pressing jacket in an unstressed state; and said pressing jacket being arranged to rest against a free end of said outlet surface, wherein said free end of said outlet surface is structured to be bent generally radially inwardly.

16. A pressing arrangement for treating a fibrous material web, comprising:

an opposing surface;

a shoe press roll including a non-rotationally mounted carrier, a flexible pressing jacket arranged to circulate around said carrier, and at least one press shoe supported on said carrier, wherein said at least one press shoe is arranged to press said flexible pressing jacket against said opposing surface;

said shoe press roll and said opposing surface being arranged to form a press nip elongated in a jacket travel direction;

said at least one press shoe comprising an outlet surface arranged to extend beyond, in the jacket travel direction, an end of said press nip;

said at least one press shoe being arranged to press said pressing jacket against said opposing surface such that, in a region of said press nip, said pressing jacket is moved radially outside of a circular path formed by said pressing jacket in an unstressed state; and said pressing jacket being arranged to rest against a free end of said outlet surface, wherein said free end of said outlet surface comprises a rounded transitional region generally bent radially inwardly, and said pressing jacket is arranged to rest against said outlet.

17. An apparatus for treating a fibrous material web, comprising:

shoe press roll comprising a flexible rotatable roll jacket and at least one press shoe arranged to press against an inner surface of said roll jacket;

an opposing surface, said shoe press roll and said opposing surface being arranged to form a press nip elongated in a roll jacket travel direction;

said press shoe comprising a press surface structured and arranged to define said press nip and an outlet surface positioned obliquely adjacent an end of said press surface forming an exit of said press nip, in relation to the roll jacket travel direction;

said at least one press shoe being arranged to press said roll jacket against said opposing surface such that, in a press nip region, said pressing jacket is moved radially outside of a circular path formed by said pressing jacket in an unstressed state, said rotatable jacket being arranged to rest against a free end of said outlet surface.

18. The apparatus in accordance with claim 17, further comprising at least one dewatering belt structured and arranged to guide the fibrous material web through said press nip.

19. The apparatus in accordance with claim 17, wherein, when said press shoe is press against said opposing surface, said roll jacket, in said region of said press nip, is moved a distance from the circular path of less than approximately 3% of a diameter of the circular path.

20. An apparatus for treating a fibrous material web, comprising:

shoe press roll comprising a flexible rotatable roll jacket and at least one press shoe arranged to press against an inner surface of said roll jacket;

an opposing surface, said shoe press roll and said opposing surface being arranged to form a press nip elongated in a roll jacket travel direction;

said press shoe comprising a press surface structured and arranged to define said press nip and an outlet surface positioned obliquely adjacent an end of said press surface forming an exit of said press nip, in relation to the roll jacket travel direction;

said at least one press shoe being arranged to press said roll jacket against said opposing surface such that, in a press nip region, said pressing jacket is moved radially outside of a circular path formed by said pressing jacket in an unstressed state, wherein, in roll jacket travel direction, a length of said outlet surface is greater than approximately one-half a length of said press nip.

21. The apparatus in accordance with claim 20, wherein said length of said outlet surface is greater than or equal to about said length of said press nip.

22. The apparatus in accordance with claim 20, wherein said length of said outlet surface is greater than or equal to about said length of said press nip.

23. An apparatus for treating a fibrous material web, comprising: shoe press roll comprising a flexible rotatable roll jacket and at least one press shoe arranged to press against an inner surface of said roll jacket;

an opposing surface, said shoe press roll and said opposing surface being arranged to form a press nip elongated in a roll jacket travel direction;

said press shoe comprising a press surface structured and arranged to define said press nip and an outlet surface positioned obliquely adjacent an end of said press surface forming an exit of said press nip, in relation to the roll jacket travel direction;

said at least one press shoe being arranged to press said roll jacket against said opposing surface such that, in a press nip region, said pressing jacket is moved radially outside of a circular path formed by said pressing jacket in an unstressed state, wherein, in the roll jacket travel direction, a length of said outlet surface is greater jacket, in said region of said press nip, is moved a distance from the circular path of between approximately 1 to approximately 3% of a diameter of the circular path.

24. The apparatus in accordance with claim 23, wherein the distance from circular path moved by said roll jacket, in said region of said press nip, is between approximately 1.5 and approximately 2.5% of the diameter of the circular path.

25. The apparatus in accordance with claim 23, wherein the distance from the circular path moved by said pressing jacket, in said region of said press nip, is approximately 2% of the diameter of the circular path.

26. An apparatus for treating a fibrous material web, comprising:

shoe press roll comprising a flexible rotatable roll jacket and at least one press shoe arranged to press against an inner surface of said roll jacket;

an opposing surface, said shoe press roll and said opposing surface being arranged to form a press nip elongated in a roll jacket travel direction;

said press shoe comprising a press surface structured and arranged to define said press nip and an outlet surface positioned obliquely adjacent an end of said press surface forming an exit of said press nip, in relation to the roll jacket travel direction;

said at least one press shoe being arranged to press said roll jacket against said opposing surface such that, in a press nip region, said pressing jacket is moved radially outside of a circular path formed by said pressing jacket in an unstressed state, wherein said outlet surface is obliquely arranged adjacent said press surface to form an angle of approximately 18° to said press surface.

27. An apparatus for treating a fibrous material web, comprising:

shoe press roll comprising a flexible rotatable roll jacket and at least one press shoe arranged to press against an inner surface of said roll jacket;

an opposing surface, said shoe press roll and said opposing surface being arranged to form a press nip elongated in a roll jacket travel direction;

said press shoe comprising a press surface structured and arranged to define said press nip and an outlet surface positioned obliquely adjacent an end of said press surface forming an exit of said press nip, in relation to the roll jacket travel direction;

said at least one press shoe being arranged to press said roll jacket against said opposing surface such that, in a press nip region, said pressing jacket is moved radially outside of a circular path formed by said pressing jacket in an unstressed state, wherein a free end of said outlet surface opposit said press surface comprises a rounded transition region.

28. The apparatus in accordance with claim 18, further comprising at least one dewatering belt structured and arranged to guide the fibrous material web through said press nip.

29. A pressing arrangement for treating a fibrous material web, comprising:

an opposing surface;

a shoe press roll including a non-rotationally mounted carrier, a flexible pressing jacket arranged to circulate around said carrier, and at least one press shoe supported on said carrier, wherein said at least one press shoe is arranged to press said flexible pressing jacket against said opposing surface;

said shoe press roll and said opposing surface being arranged to form a press nip elongated in a jacket travel direction;

said at least one press shoe comprising an outlet surface arranged to extend beyond, in the jacket travel direction, an end of said press nip;

said at least one press shoe being arranged to press said pressing jacket against said opposing surface such that, in a region of said press nip, said pressing jacket is moved radially outside of a circular path formed by said pressing jacket in an unstressed state; and said pressing jacket being arranged to rest against a free end of said outlet surface, wherein, when said press shoe is pressed against said opposing surface, said pressing jacket, in said region of said press nip, is moved a distance from the circular path of less than approximately 3% of a diameter of the circular path.

30. An apparatus for treating a fibrous material web, comprising:

shoe press roll comprising a flexible rotatable roll jacket and at least one press shoe arranged to press against an inner surface of said roll jacket;

an opposing surface, said shoe press roll and said opposing surface being arranged to form a press nip elongated in a roll jacket travel direction;

said press shoe comprising a press surface structured and arranged to define said press nip and an outlet surface positioned obliquely adjacent an end of said press surface forming an exit of said press nip, in relation to the roll jacket travel direction;

said at least one press shoe being arranged to press said roll jacket against said opposing surface such that, in a press nip region, said pressing jacket is moved radially outside of a circular path formed by said pressing jacket in an unstressed state, wherein, when said press shoe is pressed against said opposing surface, said roll jacket, in said region of said press nip, is moved a distance from the circular path of less than approximately 3% of a diameter of the circular path.

* * * * *